US007630881B2

(12) United States Patent
Iser et al.

(10) Patent No.: US 7,630,881 B2
(45) Date of Patent: Dec. 8, 2009

(54) BANDWIDTH EXTENSION OF BANDLIMITED AUDIO SIGNALS

(75) Inventors: Bernd Iser, Ulm (DE); Gerhard Uwe Schmidt, Ulm (DE)

(73) Assignee: Nuance Communications, Inc., Burlington, MA (US)

( * ) Notice: Subject to any disclaimer, the term of this patent is extended or adjusted under 35 U.S.C. 154(b) by 792 days.

(21) Appl. No.: 11/229,027

(22) Filed: Sep. 16, 2005

(65) Prior Publication Data

US 2006/0106619 A1 May 18, 2006

(30) Foreign Application Priority Data

Sep. 17, 2004 (EP) ..... 04022198

(51) Int. Cl.
*G10L 19/00* (2006.01)

(52) U.S. Cl. ..... 704/203; 704/212; 704/504; 370/234; 370/468

(58) Field of Classification Search ..... 704/203, 704/212, 504; 370/234, 468
See application file for complete search history.

(56) References Cited

U.S. PATENT DOCUMENTS

| | | | | |
|---|---|---|---|---|
| 5,455,888 | A | 10/1995 | Iyengar et al. | |
| 5,978,759 | A | 11/1999 | Tsushima et al. | |
| 7,346,007 | B2 * | 3/2008 | Curcio et al. | 370/252 |
| 2001/0044722 | A1 | 11/2001 | Gaustafsson et al. | |
| 2002/0138268 | A1 | 9/2002 | Gustafsson | |
| 2002/0154656 | A1 * | 10/2002 | Kitchin | 370/468 |
| 2003/0093279 | A1 * | 5/2003 | Malah et al. | 704/265 |
| 2005/0187759 | A1 * | 8/2005 | Malah et al. | 704/200 |

OTHER PUBLICATIONS

Epps, J. and Holmes, W.H., "A New Technique for Wideband Enahncement of Coded Narrowband Speech", *IEEE*, 1999, pp. 174-176.

Epps, J. and Holmes, W.H., Speech Enhancement Using STC-Based Bandwidth Extension, *Proc. International Conference on Spoken Language*, Sidney Australia, 1998, 4 pages.

Iser, Bernd et al., "Neural Networks Versus Codebooks in an Application for Bandwidth Extension of Speech Signals", *Eurospeech 2003—Geneva*, 2003, 4 pages.

Kornagel, Ulrich, "Spectral Widening of the Exitation Signal for Telephone-Based Speech Enhancement", *International Workshop on Acoustic Echo and Noise Control*, Germany 2001, pp. 215-218.

Schnitzler, Jürgen, "A 13.0 Kbit/s Wideband Speech Codec Based on SB-ACELP", *IEEE*, 1998, pp. 157-160.

* cited by examiner

*Primary Examiner*—Daniel D Abebe
(74) *Attorney, Agent, or Firm*—Sunstein Kann Murphy & Timbers LLP

(57) ABSTRACT

A system extends a bandwidth of bandlimited audio signals by analyzing bandlimited audio signals at a transmission cycle rate. The analyzer may obtain a bandlimited parameter at a transmission cycle rate. A mapping device or logic in the system obtains a wideband parameter based on the bandlimited parameter. An audio signal generator generates a highband and/or lowband audio signal based on the wideband parameter at the transmission cycle rate. In some systems, the bandlimited audio signal is analyzed at the transmission cycle rate. The highband and/or lowband audio signals and the combined wideband audio signal are generated at the transmission cycle rate.

39 Claims, 3 Drawing Sheets

BANDWIDTH EXTENSION OF BANDLIMITED AUDIO SIGNALS

BACKGROUND OF THE INVENTION

1. Priority Claim

This application claims the benefit of priority from European Application No. 04022198.8 filed Sep. 17, 2004, which is incorporated herein by reference.

2. Technical Field

The invention relates to processing of bandlimited signals and, more particularly relates to processing of bandlimited audio signals.

3. Related Art

The transmission of audio signals may occur with some bandwidth limitations. Whereas face-to-face speech communication covers a frequency range from 20 Hz to 20 kHz, telephone communication may use a more limited bandwidth. Some bandlimited audio and, in particular, speech signals have a bandwidth of 300 Hz to 3.4 kHz. Since the removal of signals with lower and higher frequencies causes a degradation in speech quality, such as in reduced intelligibility, it would be beneficial to extend the limited bandwidth.

Despite developments in extending bandlimited telephone communications, a need exists to improve audio and speech processing through bandwidth extension.

SUMMARY

A system extends a bandwidth of bandlimited audio signals by analyzing bandlimited audio signals at a transmission cycle rate. The analyzer may obtain a bandlimited parameter at a transmission cycle rate. A mapping device in the system obtains a wideband parameter based on the bandlimited parameter. An audio signal generator generates a highband and/or lowband audio signal based on the wideband parameter at the transmission cycle rate. In some systems, the bandlimited audio signal is analyzed at the transmission cycle rate. The highband and/or lowband audio signals and the combined wideband audio signal are generated at the transmission cycle rate.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
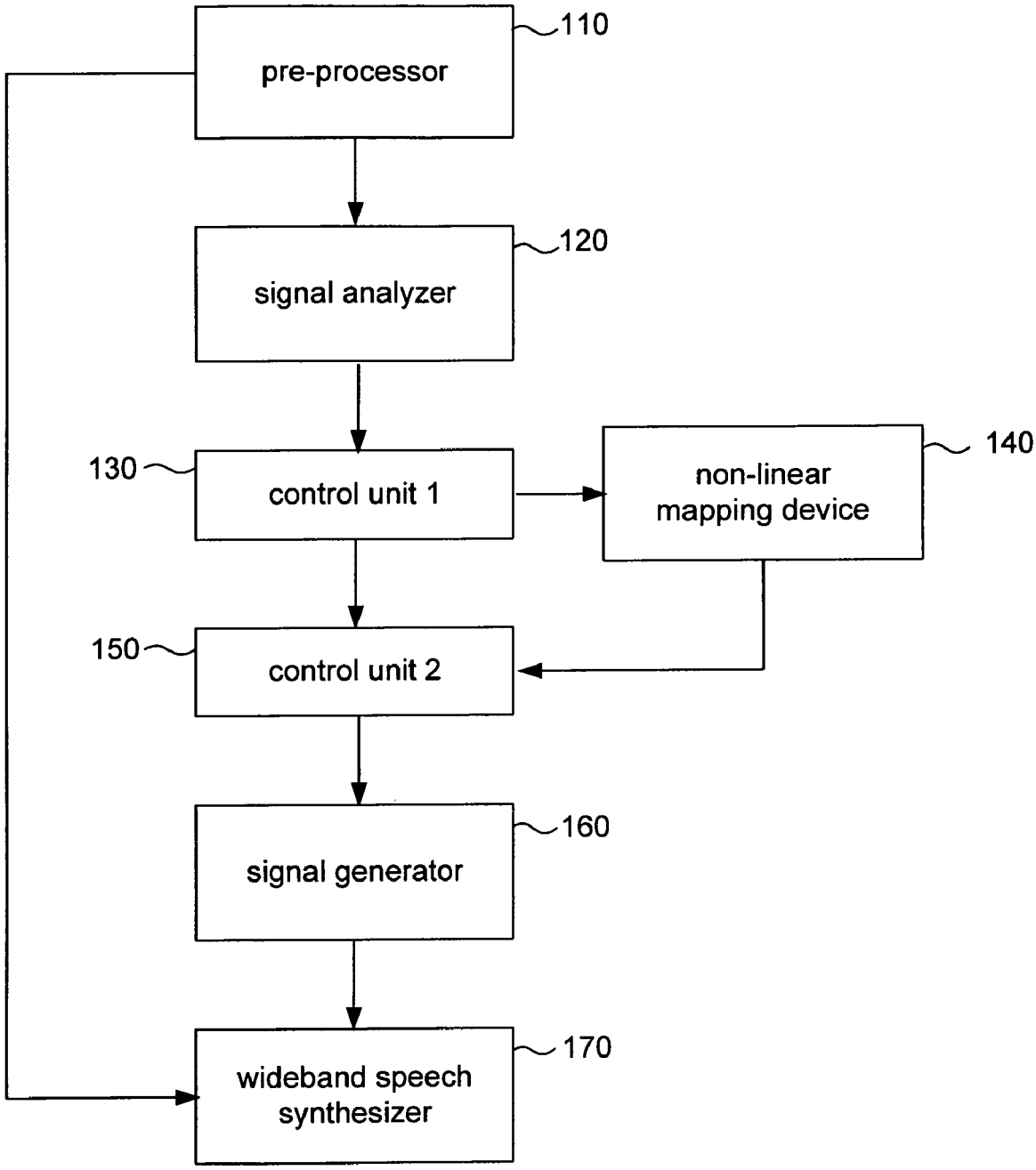
FIG. 1 is a system that extends the bandwidth of audio signals.

A bandlimited extension system may provide a continuous synthesizing of wideband audio signals even if verbal utterances of the sending party show a high temporal variability. The system may be used for bandwidth extension in speech telecommunication systems to improve the intelligibility and the naturalness of the received voice. In particular, the operation of an analyzer and a generator at a transmission cycle rate may create a substantially delay-free voice communication through continuous synthesizing of amplitudes, frequencies and phases of the wideband audio and, in particular, speech signals.

The audio or speech analyzer may estimate the pitch of the voice and extract the bandlimited excitation signal and the bandlimited spectral envelope and may provide the associated bandlimited parameters. In some systems, the bandlimited parameters are characteristics. These characteristics may include the determination of bandlimited spectral envelopes, the pitch, the short-time power, the highband-pass-to-lowband-pass power ratio and the signal-to-noise ratio. The wideband parameters may comprise parameters for the wideband audio signal corresponding to the bandlimited parameters. These parameters may be characteristic parameters for the determination of wideband spectral envelopes and wideband excitation signals.

Some pre-processing, such as increasing the sample rate by interpolation, may be performed before analyzing. To keep the processor load relatively low, the system may implement recursive algorithms in the analyzer. The method of Linear Predictive Coding (LPC) may be used to extract the bandlimited spectral envelope. In this method, the n-th sample of a time signal x(n) may be estimated from M preceding samples as $$x(n) = \sum_{k=1}^{M} a_k(n) \cdot x(n-k) + e(n)$$

with the coefficients $a_k(n)$ that may be optimized in a way to minimize the predictive error signal e(n). The optimization may be done recursively, such as through the Least Mean Square algorithm. The wideband spectral envelope may be assigned to the extracted bandlimited spectral envelope by some non-linear mapping method.

Based on the analysis of the bandlimited speech signal a wideband excitation signal may be generated. This wideband excitation signal may be shaped by the estimated wideband spectral envelope to generate a wideband speech signal.

Several other speech analysis procedures may be performed by the speech analyzer and may be used in subsequent synthesizing of lowband/highband speech signals complementing the transmitted bandlimited speech signal. The short-time power, the actual Signal-to-Noise Ratio (SNR), the highband-pass-to-lowband-pass power ratio, and signal nullings may be determined and classified with respect to voiced and unvoiced portions of the detected speech signal. 'Highband' and 'lowband' refers to those parts of the frequency spectrum that may be synthesized in addition to the received band. In some bandlimited signals within about 300 Hz to about 3.4 kHz range, the lowband and the highband signals may have frequency ranges from about 50 to about 300 Hz and from about 3.4 kHz to a predefined upper frequency limit with a maximum of half of the sampling rate, respectively.

The systems may include a combination or summing device that receives the bandlimited audio signal and the highband and/or lowband audio signal generated by the generator at the transmission cycle rate. The combination or summing device may combine the bandlimited audio signal and the highband and/or lowband audio signal to a wideband audio signal at the transmission cycle rate.

In some systems, a controller receives a bandlimited parameter, where the controller controls a mapping device or logic to obtain a wideband parameter. If a particular condition is fulfilled, the wideband parameter is obtained at an event rate that is lower than the transmission cycle rate.

A real-time processing part of the system may receive and analyze the bandlimited audio signal and generate the highband and/or lowband audio signals. The controller may operate asynchronously as it controls the mapping device or logic to obtain a wideband parameter not at the transmission cycle rate. The controller may operate at a lower rate which may be an "event rate." By these processing rates, the processor load may be significantly reduced.

In some systems, it may not be necessary to obtain wideband parameters. In some situations, a significant modification of the audio signal may occur and the generation of the highband and/or lowband audio signals may need to be modified.

The controller may control the audio signal generator to adapt to nominal values for parameters, such as frequency, phase and amplitude, that are needed to generate highband and/or lowband audio signals. The nominal values may be modified based on the wideband parameter at the event rate.

The audio or speech signal generator may perform at a cycle rate. The audio or speech signal generator may operate in real-time with actual values. These values may include the frequencies and the amplitudes. The system may also control the audio signal generator by adapting it to the nominal values at a lower rate than the transmission cycle rate.

The audio signal generator may be adapted to the nominal values with a limit maximum increment for every transmission cycle. The maximum increment, in particular, may be based on the temporal variability of speech generation.

The signal generator may comprise a sine wave generator. The sine wave generator may operate continuously but may not adapt immediately to nominal values. It may be adapted at a predefined adaptation speed that may be the temporal variability of the utterances of a speaker. As a result, short-term erroneous analysis data may not have a severe impact on the synthesized speech signals and phase discontinuities may be avoided.

The controller may comprise a first and a second controller or control unit. The first control unit may be configured to generate an event signal if a particular condition is fulfilled, and may control the mapping device or logic to obtain a wideband parameter if an event signal is generated. The second control unit may receive the event signal and the wideband parameter. If the event signal is received, the second control unit may modify the nominal values for parameters needed to generate highband and/or lowband audio signals.

The first and second control unit may be distinguished from each other logically and/or physically. The second control unit may control the audio signal generator on the cycle rate basis. If an event signal is generated by the first control unit, it may modify the nominal values for the audio generator on the event signal basis rate (event rate) lower than the cycle rate.

One particular condition may be given by a bandlimited parameter exceeding a pre-determined limit, or the difference between the values of the bandlimited parameter for two subsequent pulses of the event rate exceeding a pre-determined limit, or if a pre-determined number of cycle rates is exceeded. Besides geometric distance measures for vector quantities, psychoacoustic distance measures may also be employed.

Furthermore, the analyzer and/or the controller may generate reliability codes used to control the audio signal generator. If the analyzer provides reliability codes for the different results of the analysis, the controller may obtain combined confidence information on the parameters used for the generation of the highband/lowband audio signals.

The controller may generate its own reliability codes. If an estimated pitch has a high reliability as indicated by different analyzing tools, the controller may direct the generator to generate audio signals without any or with little smoothing. Different influences on the re-calculation of wideband parameters might be weighted according to the respective reliability codes.

Pre-determine limits may be established for the reliability codes. If an actual reliability code of an analyzing process falls below a pre-determined limit, no adaptation of the wideband parameters may occur and no modification of the nominal values calculated to control the signal processor may be carried out.

The mapping device or logic may comprise code books and/or artificial neural networks providing a correlation between a bandlimited parameter and a wideband parameter. The first code book of this pair may be trained with bandlimited sample vectors for the spectral envelope. The second code book may trained with wideband vectors. The training may be based on a vector quantization method. In some systems, the LPC coefficients of the bandlimited code book may be determined. A mapping to the associate vector of the wideband code book may determine the parameters to be used to estimate the wideband spectral envelope.

Alternatively, or in addition to the code books, other methods of non-linear mapping of an analyzed bandlimited speech signal to a wideband speech signal may be used including artificial neural networks. Before non-linear mapping, some transform of the obtained wideband parameters may be performed. The audio signal generator may comprise sine wave generators or a combination of sine wave generators and noise generators. The system may be used in a hands-free system and, in particular, a hands-free system for use in a vehicle comprising the inventive system as described above.

A method may also generate a wideband audio signal from a bandlimited audio signal, by receiving and analyzing a bandlimited audio signal at a transmission cycle rate. The method may obtain a bandlimited parameter at the transmission cycle rate and assign a wideband parameter to the bandlimited parameter. The method generates a highband and/or lowband audio signal based on the wideband parameter at the transmission cycle rate. The method combines the bandlimited audio signal and the highband and/or lowband audio signal generated by the audio signal generator with a wideband audio signal at the transmission cycle rate.

The method may assign the wideband parameter to the bandlimited parameter by utilizing code books and/or artificial networks. A wideband parameter may be assigned to the bandlimited parameter at an event rate that is lower than the transmission cycle rate, only if at least one particular condition is fulfilled. Nominal values for parameters, in particular, frequency and amplitude, may be used to generate highband and/or lowband audio signals. These nominal values may be modified based on the wideband parameter at the event rate. An audio signal generator may adapt to the nominal values with a limit maximum increment for every transmission cycle.

The event signal may be generated, if a particular condition is fulfilled. The wideband parameter may be assigned to the bandlimited parameter and the nominal values for parameters needed to generate highband and/or lowband audio signals may only be modified, if an event signal is generated. One particular condition employed in the method may be fulfilled if the value of the at least one bandlimited parameter exceeds a pre-determined limit, or if the difference between the values of the at least one bandlimited parameter for two subsequent pulses of the event rate, (e.g., the difference between the current analysis value and the value determined at the last event), exceeds a pre-determined limit, or if a pre-determined number of cycle rates is exceeded.

The method may include calculating reliability codes for the bandlimited parameter and/or a combination of more than one bandlimited parameter and/or the wideband parameter and/or a combination of more than one wideband parameter. The reliability codes may be used to control the audio signal generator. The highband and/or lowband audio signals may be generated at a cycle rate by using sine wave generators or through sine wave and noise generators FIG. 1 illustrates a system that extends the bandwidth of bandlimited signals. A bandlimited speech signal is pre-processed by a pre-processor 110. The pre-processor may send a detected bandlimited speech signal to a signal analyzer 120 and to the wideband speech synthesizer or a combination device 170. Alternatively, the pre-processing bandlimited speech signal may be moved to a desired bandwidth by increasing the sample rate, without, however, generating additional frequency ranges. If a bandlimited signal is sampled at about 8 kHz it may be fed to an interpolation device for pre-processing which outputs the signal at a sampling frequency of about 16 kHz. If the sample rate is increased, a band-pass filter may pass a frequency range of the received bandlimited signal to the wideband speech synthesizer or the combination device 170.

The signal analyzer 120 works on a transmission cycle rate basis and comprises a module for extracting the bandlimited spectral envelope from the pre-processed speech signal. One method to calculate a predictive error filter is through a Linear Predictive Coding (LPC) method. The coefficients of the predictive error filter may be used for a parametric determination of the bandlimited spectral envelope. Alternatively, models for spectral envelope representation based on line spectral frequencies or cepstral coefficients or mel-frequency cepstral coefficients may be used.

An optimization issue for the predictive error may be solved by a linear equation system incorporating an autocorrelation matrix. An algorithm that may solve this algebraic equation systems is the Levinson-Durbin algorithm. The processor load for performing an LPC analysis by using the Levinson-Durbin algorithm may lower than the load of a standard Fast Fourier Transform.

Alternatively, an iterative algorithm may be used that is based on the Least Mean Square method in order to reduce the processor load. If the signal processing is performed with the Fourier transformed time signals X(f), the spectral envelope may be modeled on the basis of the all-pole transmission function W(f) in frequency (f) space $$W(f) = \left(1 - \sum_{k=1}^{M} a_k \cdot \exp(-2 \cdot \pi \cdot i \cdot f \cdot k \cdot t)\right)^{-1} \quad X(f) = W(f) \cdot E(f)$$

with the time delay k·t of the m-th signal out of M samples and where the $a_k$ and E(f) denote the predictive coefficients and the error signal, respectively. The associated model is known as the Auto-Regressive Model that may be employed as a highly efficient recursive method for the calculation of the bandlimited spectral envelope.

The signal analyzer 120 may comprise logic for estimating the wideband excitation signal, which may be done by analyzing non-linear characteristic lines. A wideband excitation signal represents the signal that would be detected almost immediately at the vocal chords without modifications by the whole vocal tract, and is commonly known as the glottal signal. The estimated wideband excitation signal may subsequently be shaped by the estimated wideband spectral envelope to obtain a synthesized wideband signal.

Additional signal analyzing logic that may be incorporated within the system may include logic that determines the actual SNR, the short time power of the excitation signal, the formants, the pitch, the high-pass-to-low-pass power ratio or for a classification based on voiced and unvoiced portions of the detected verbal utterance. Each of the components of the speech analyzer may also output reliability codes, including reliability code numbers. When numbers are used they may be scalar, ranging from about 0 to about 1, that measure the confidence level of the estimated parameters such as the pitch.

The reliability code numbers obtained by the signal analyzer 120 are received by a first control unit 130. Based on the received data the first control unit 130 generates event signals. An event signal may be generated when some pre-determined condition is fulfilled. Reasonable conditions comprise the exceeding of a well-defined distance, such as the Euclidian distance, or a simple difference between parameters that were obtained at the time of the last generation of an event signal and the parameters that were actually obtained by the signal analyzer 120.

The first control unit 130 may not work on the transmission cycle rate basis and may be active with a variable rate lower than the transmission cycle rate. On the other hand, it is also possible to enforce the generation of an event signal every $n_H$>1 cycle periods to avoid some freezing of the control.

After the results of all of the components of the speech analyzer 120 have been obtained, new reliability code numbers may be calculated. Since the control unit 130 receives the data, it may provide a combined estimate of the confidence level(s) of the analysis data. Moreover, the individual reliability code numbers obtained by different components of the signal analyzer 120 may be used by the control unit 130 to obtain new reliability code numbers.

The first control unit 130 may be capable of generating an event signal indicating that the actual analysis data demands a modification of the wideband speech synthesizing. If an event signal is generated by the first control unit 130, which may indicate a temporal change of the bandlimited spectral envelope, a new estimation of the wideband parameters, such as the wideband LPC coefficients, corresponding to the changed bandlimited parameters may be necessary.

The estimation of the wideband parameters on the basis of the calculated bandlimited parameters may be performed by some non-linear mapping device or logic 140. A pair of code books may be used to assign wideband parameters contained in one code book to bandlimited parameters contained in another code book. The bandlimited speech signal may be analyzed and the closest representation in the bandlimited code book may be identified. The corresponding wideband signal representation is then determined and used to synthesize the wideband speech signal.

The system may synthesize the whole wideband signal or, alternatively, may add the synthesized speech signal portion outside the bandwidth of the bandlimited signal, such as the highband and lowband speech signals, to the detected and analyzed bandlimited signal.

Artificial neural networks may be used to complement, or in place of, the code books as non-linear mapping device or logic 140. The weights of such networks may be trained off-line before usage, but may include online training in connection with individual reliability code numbers. While some artificial neural networks and code books require training, depending on the actual application and implementation, some systems do not use methods that require training, such as the Yasukawa approach that is based on the linear extrapolation of the spectral slope of the bandlimited spectral envelope to the upper band.

The obtained wideband parameters and the event signal are received by a second control unit 150 that is provided to control the signal generator 160 by determining new nominal values for the speech signal synthesis. The second control unit 150 may be logically and/or physically separated from the first control unit 130.

If a new pitch has been estimated by the signal analyzer 120, and accordingly an event signal has been generated by the first control unit 130, the second control unit 150 may be used by a new wideband extension of the analyzed speech signal. The second control unit 150 adjusts nominal values for the signal generator 160. The second control unit 150 may provide the signal generator 160 with information about the confidence levels of the estimated wideband parameters and/or limits for the speed of revision of signal synthesizing to avoid discontinuities in the generated sine tones.

A parameter $\Delta_{i,max}$ may be used to control the i-th sine wave generator to change the actual value of the frequency each cycle rate by $\Delta_{i,max}$ at maximum. Moreover, when $\Delta_{i,min}<\Delta_{i,max}$ and employing a confidential code number $0\leqq c_i\leqq 1$ (a small number stands for a low confidence level) for the frequency change, the maximum speed of revision with respect to a frequency change of the i-th sine generator may be measured by $\Delta_{i,min}=\Delta_{i,min}+c_i(\Delta_{i,max}-\Delta_{i,min})$.

While the signal generator 160 may receive control signals from the second control unit 150 that may change on the basis of event signals, the signal generator 160 works at the transmission cycle rate. The signal generator 160 adapts to the nominal values with a limited adaptation speed based on the physical generation of natural speech.

Figure 2:
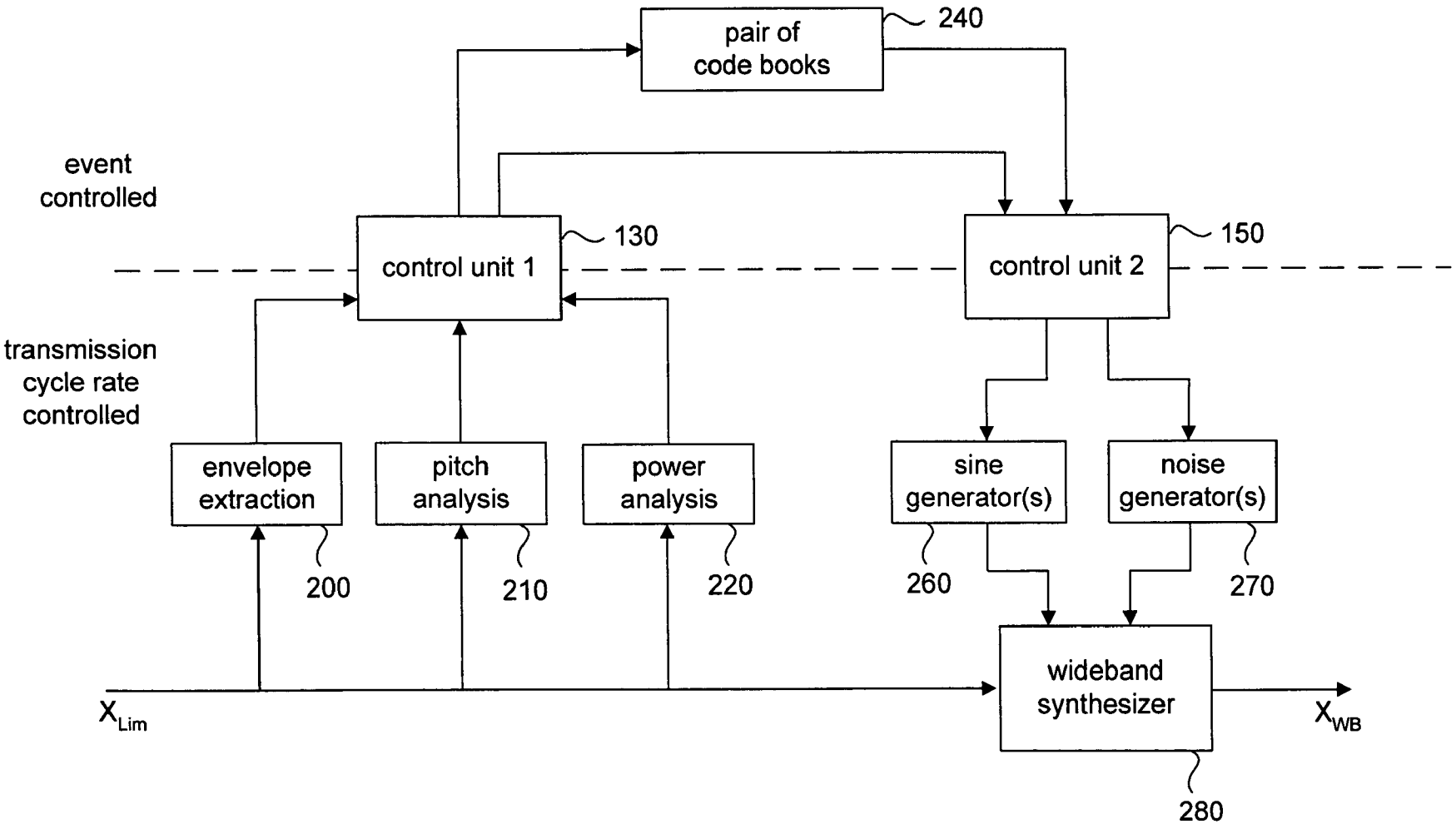
FIG. 2 is a second system that extends the bandwidth of audio signals.

FIG. 2 illustrates another system in which the elements depicted below the dashed line work on a transmission cycle rate basis, and the elements depicted above the dashed line work on an event signal basis. A bandlimited speech signal $x_{lim}$ is detected and received by a signal analyzer comprising components configured for extracting the bandlimited spectral envelope 200, for pitch analysis 210 and for determining the power of the bandlimited excitation signal 220. The components of the signal analyzer 200, 210 and 220 may exchange data with each other.

A control parameter for sine wave generators 260 may comprise a pitch frequency parameter. This parameter can be obtained through the pitch analyzer by performing an inverse Fast Fourier Transform on the logarithm of the spectrum to generate a cepstral signal. The pitch of the verbal utterance appears as a peak in the cepstral signal which may be detected by a peak picking algorithm. Amplitudes for the sine wave and frequencies responses for the noise generators may be obtained from the generated broadband spectral envelope.

The first control unit 130 receives the data obtained by the analyzer components 200, 210 and 220 and decides whether the synthesizing of the wideband speech signal should be modified. It is possible to have different rates for generating event signals by the first control unit 130 for different parameters. The rate of generating event signals should be lower than the transmission cycle rate.

If the first control unit 130 generates an event signal due to a change of cepstral coefficients compared to the set of cepstral coefficients that was determined the last time a cepstral event signal was generated with a distance measure exceeding some pre-determined limit, a pair of code books 240 may be used. The code books 240 may estimate wideband parameters that generate a modified wideband speech signal. Using the code books 240 the wideband spectral envelope for a given determined bandlimited one may be estimated.

Based on the data received from the first control unit 130 and the code books 240, the second control unit 150 controls sine wave generators 260 and noise generators 270 to generate lowband and highband (as compared to the limited bandwidth of the received signal $x_{Lim}$) speech signals. Both generators may work on a transmission cycle rate basis. The second control unit 150 may determine new nominal values for the generators 260 and 270 and may output reliability code numbers and limits for the speed of revision of signal synthesizing.

The sine wave generators 260 may synthesize the lowband extension in a frequency range of about 30 to about 300 Hz and in the highband extension in a frequency range from about 3.4 kHz to a predefined frequency. The speech signal generation may be based on pitch frequency and integer multiples.

At the transmission cycle rate, a wideband synthesizer 280 receives the bandlimited signals $x_{Lim}$ and the signals generated by the sine wave generators 260 and the noise generator 270 to synthesize the final wideband speech signals $x_{WB}$. The synthesizer 280 may comprise band-stop filters that are used to generate the synthetically generated signals. The synthesizer 280 may add these filtered signals to the unmodified bandlimited signals $x_{Lim}$ to obtain the wideband speech signals $x_{WB}$.

Figure 3:
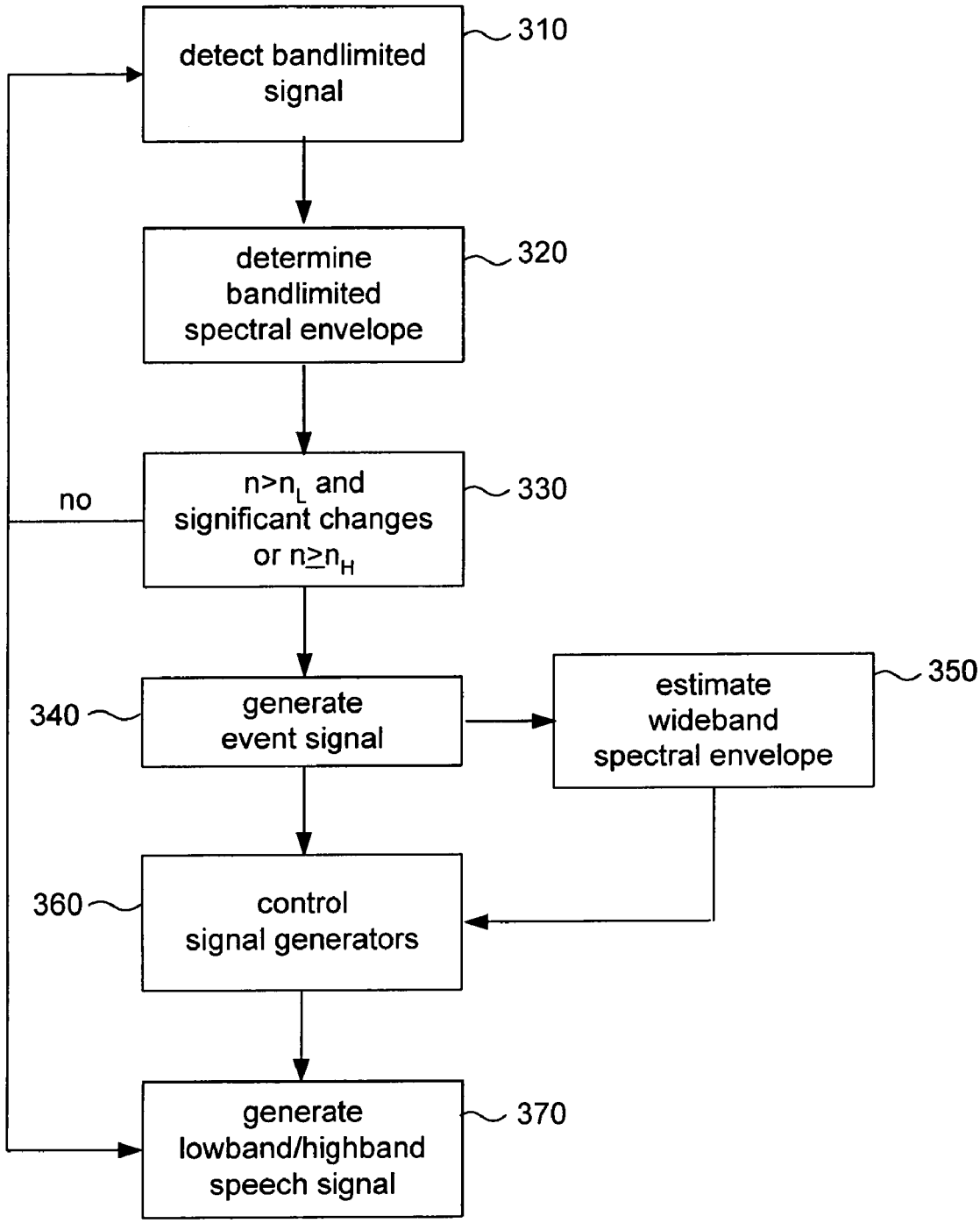
FIG. 3 is a method that extends the bandwidth of audio signals.

FIG. 3 is a method that extends the bandwidth of audio signals. The implemented algorithms may work recursively and on the transmission cycle rate basis. In particular, the bandlimited spectral envelope is determined 320 through an LPC analysis. The bandlimited parameters for a parametric description of the bandlimited spectral envelope and reliability code numbers are output to a control unit.

This control unit checks 330, whether generation of an event signal is enforced ($n\geqq n_H$) or whether a pre-determined integer multiple $n_L$ of the cycle time is exceeded by the time period (n times the cycle time) elapsed since the last generation of an event signal. If $n>n_L$, it is checked further, looking for significant changes in the bandlimited parameters, in particular, changes in the parameters for the bandlimited spectral envelope that have occurred 330. A significant change occurs, if some pre-determined distance measure is exceed by the (vector) differences between actual bandlimited parameters, such as the LPC coefficients for modeling the spectral envelope, and the respective parameters that were determined the last time an event was generated, or if one parameter exceeds a pre-determined threshold.

If $n<n_L$ or no significant changes of the bandlimited parameters have been detected, the lowband and highband speech signals are generated 370 with a pre-determined speed of adaptation to the nominal control parameters. In one case, a new event signal is generated 340 and the wideband spectral envelope corresponding to the bandlimited one is estimated 350. A pair of code books may be used. The first code book of this pair has been trained with bandlimited sample vectors for the spectral envelope and the second code book has been trained with wideband vectors. The training may be based on a vector quantization method like the Linde-Buzo-Gray design scheme based on the Euclidian or any other distance of code words.

After determining the bandlimited parameters of the bandlimited spectral envelope 320, the parameter vector is assigned to the vector of the bandlimited code book with the smallest distance to this parameter vector. As a distance measure, the Itakuro-Saito distance measure may be used. The vector determined in the bandlimited code book is mapped to the corresponding vector of the wideband code book 350, which is used for synthesizing the wideband speech signal.

Using the information of the event signal, in particular, on what wideband parameters are to be updated, and the parameters for the wideband spectral envelope, the signal generators are controlled 360 to generate the lowband and highband speech portions 370 missing in the detected 310 and analyzed bandlimited speech signal.

Sine wave generators may be adapted to nominal values for amplitude and frequencies. Noise generators may be adapted to the power of the spectral envelope. This may be different in a system where the generation of the lowband and highband speech signal is performed on a cycle rate basis. In that system the signal generators work continuously with their actual values while the nominal values are modified on an event signal basis, e.g., only every $n_H > n > n_L \geqq 1$ times the cycle time periods.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A system comprising:

an analyzer that analyzes bandlimited audio signals at a transmission cycle rate that obtains a bandlimited parameter at the transmission cycle rate, a mapping device that obtains a wideband parameter based on the bandlimited parameter, and an audio signal generator that generates an audio signal based on the wideband parameter at the transmission cycle rate, wherein:

the analyzer generates reliability codes to control the audio signal generator.

2. The system according to claim 1, where the bandlimited parameter comprises a characteristic parameter that determines a bandlimited spectral envelopes, a pitch, a short-time power ratio, a highband-pass-to-lowband-pass power ratio, or a signal-to-noise ratio.

3. The system according to claim 1 where the wideband parameter comprises a wideband spectral envelope, a characteristic parameter for the determination of wideband spectral envelopes, or a wideband excitation signal.

4. The system according to claim 1 where the mapping device comprises a code book or a neural network that provides a correlation between the bandlimited parameter and the wideband parameter.

5. The system according to claim 1 further comprising:

combination logic that receives the bandlimited audio signal and a highband or lowband audio signal generated by the audio signal generator at the transmission cycle rate.

6. The system according to claim 1 further comprising a controller configured to receive the bandlimited parameter.

7. The system according to claim 6 where the controller controls the mapping device to obtain the wideband parameter at an event rate when a particular condition is met that is lower than the transmission cycle rate.

8. The system according to claim 7 where the particular condition comprises the value of the bandlimited parameter when the bandlimited parameter exceeds a pre-determined limit, or when the difference between the values of the one bandlimited parameter for two subsequent pulses of the event rate when the difference exceeds a pre-determined limit, or when a pre-determined number of cycle rates is exceeded.

9. The system according to claim 7 where the controller controls the audio signal generator to adapt to nominal values for parameters that generate a highband or lowband audio signals, and where the nominal values are modified based on the wideband parameter at the event rate.

10. The system according to claim 6 where the controller comprises a first control unit and a second control unit, and the first control unit generates an event signal, if at least one particular condition is fulfilled, and controls the mapping device to obtain a wideband parameter, only if an at least one event signal is generated, and the second control unit receives the event signal and the wideband parameter and modifies a nominal value for parameters used to generate a highband or lowband audio signal, only if the at least one event signal is received.

11. The system according to claim 6 where the controller generates reliability codes to control the audio signal generator.

12. The system according to claim 1 where the audio signal generator adapts to nominal values based on a limit maximum increment for every transmission cycle, where the maximum increment is based on a temporal variability of speech generation.

13. The system according to claim 1 where the audio signal generator comprises a sine wave generator.

14. The system according to claim 1 where the audio signal generator comprises a sine wave generator and a noise generator.

15. A method comprising:

analyzing a bandlimited audio signal at a transmission cycle rate and obtaining a bandlimited parameter at the transmission cycle rate, assigning a wideband parameter to the bandlimited parameter, where assigning the wideband parameter to the bandlimited parameter is based on an event rate that is lower than the transmission cycle rate only when a particular condition is fulfilled, generating an audio signal based on the wideband parameter at the transmission cycle rate, and combining the bandlimited audio signal and the generated audio signal to a wideband audio signal at the transmission cycle rate.

16. The method according to claim 15 where the generated audio signal comprises a highband audio signal.

17. The method according to claim 15 where the generated audio signal comprises a lowband audio signal.

18. The method according to claim 15 where:

the bandlimited parameters comprise a characteristic of determination of the bandlimited spectral envelopes, a pitch, a short-time power ratio, a highband-pass-to-lowband-pass power ratio, or a signal-to-noise ratio, and the wideband parameters comprise wideband spectral envelopes or characteristics for the determination of wideband spectral envelopes or wideband excitation signals.

19. The method according to claim 15 where assigning the wideband parameter to the bandlimited parameter comprises accessing one code book or a neural network.

20. The method according to claim 15 where nominal values for parameters generate at least one of highband or lowband audio signals, and where the nominal values are modified based on the wideband parameter at the event rate.

21. The method according to claim 20 further comprising an audio signal generator that adapts to the nominal values with a limit maximum increment for every transmission cycle, where the maximum increment is based on the temporal variability of speech generation.

22. The method according to claim 20 further comprising:

generating an event signal, if a condition is fulfilled, and assigning the wideband parameter to the bandlimited parameter and the nominal values for parameters generate at least one of highband or lowband audio signals are only modified, if an event signal is generated.

23. The method according to claim 22 where the condition is fulfilled if a difference between the values of the bandlimited parameter for two subsequent pulses of the event rate exceeds a pre-determined limit.

24. The method according claim 15 further comprising calculating reliability codes for the parameter where the reliability codes are used for controlling the audio signal generator.

25. The method according to claim 24 where the parameter comprises the bandlimited parameter.

26. The method according to claim 15 where the audio signals are generated at the transmission cycle rate by a sine wave generator or by a sine wave generator and a noise generator.

27. A system comprising:

an analyzer that analyzes bandlimited audio signals at a transmission cycle rate that obtains a bandlimited parameter at the transmission cycle rate, a mapping device that obtains a wideband parameter based on the bandlimited parameter, an audio signal generator that generates an audio signal based on the wideband parameter at the transmission cycle rate, and a controller configured to:

receive the bandlimited parameter; and, control the mapping device to obtain the wideband parameter at an event rate when a particular condition is met that is lower than the transmission cycle rate.

28. The system according to claim 27, where the bandlimited parameter comprises a characteristic parameter that determines a bandlimited spectral envelopes, a pitch, a short-time power ratio, a highband-pass-to-lowband-pass power ratio, or a signal-to-noise ratio.

29. The system according to claim 27 where the analyzer generates reliability codes to control the audio signal generator.

30. The system according to claim 27 where the wideband parameter comprises a wideband spectral envelope, a characteristic parameter for the determination of wideband spectral envelopes, or a wideband excitation signal.

31. The system according to claim 27 where the mapping device comprises a code book or a neural network that provides a correlation between the bandlimited parameter and the wideband parameter.

32. The system according to claim 27 further comprising:

combination logic that receives the bandlimited audio signal and a highband or lowband audio signal generated by the audio signal generator at the transmission cycle rate.

33. The system according to claim 27 where the particular condition comprises the value of the bandlimited parameter when the bandlimited parameter exceeds a pre-determined limit, or when the difference between the values of the one bandlimited parameter for two subsequent pulses of the event rate when the difference exceeds a pre-determined limit, or when a pre-determined number of cycle rates is exceeded.

34. The system according to claim 27 where the controller controls the audio signal generator to adapt to nominal values for parameters that generate a highband or lowband audio signals, and where the nominal values are modified based on the wideband parameter at the event rate.

35. The system according to claim 27 where the controller comprises a first control unit and a second control unit, and the first control unit generates an event signal, if at least one particular condition is fulfilled, and controls the mapping device to obtain a wideband parameter, only if an at least one event signal is generated, and the second control unit receives the event signal and the wideband parameter and modifies a nominal value for parameters used to generate a highband or lowband audio signal, only if the at least one event signal is received.

36. The system according to claim 27 where the controller generates reliability codes to control the audio signal generator.

37. The system according to claim 27 where the audio signal generator adapts to nominal values based on a limit maximum increment for every transmission cycle, where the maximum increment is based on a temporal variability of speech generation.

38. The system according to claim 27 where the audio signal generator comprises a sine wave generator.

39. The system according to claim 27 where the audio signal generator comprises a sine wave generator and a noise generator.

* * * * *

UNITED STATES PATENT AND TRADEMARK OFFICE

CERTIFICATE OF CORRECTION

PATENT NO. : 7,630,881 B2
APPLICATION NO. : 11/229027
DATED : December 8, 2009
INVENTOR(S) : Iser et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1118 days.

Signed and Sealed this

Second Day of November, 2010

David J. Kappos

David J. Kappos
*Director of the United States Patent and Trademark Office*